US005667598A

United States Patent [19]

Ozaki et al.

[11] Patent Number: 5,667,598

[45] Date of Patent: Sep. 16, 1997

[54] PRODUCTION METHOD FOR GRAIN ORIENTED SILICION STEEL SHEET HAVING EXCELLENT MAGNETIC CHARACTERISTICS

[75] Inventors: Yoshihiro Ozaki; Akio Fujita; Mineo Muraki, all of Okayama, Japan

[73] Assignee: Kawasaki Steel Corporation, Japan

[21] Appl. No.: 622,390

[22] Filed: Mar. 27, 1996

[51] Int. Cl.[6] ..... H01F 1/14

[52] U.S. Cl. ..... 148/111; 148/113

[58] Field of Search ..... 148/111, 113

[56] References Cited

U.S. PATENT DOCUMENTS

| | | | |
|---|---|---|---|
| 5,039,359 | 8/1991 | Yoshimoto et al. | 148/111 |
| 5,082,510 | 1/1992 | Nishimoto et al. | 148/111 |
| 5,354,389 | 10/1994 | Arai et al. | 148/111 |
| 5,545,263 | 8/1996 | Yoshitomi et al. | 148/111 |

FOREIGN PATENT DOCUMENTS

| | | |
|---|---|---|
| 0 184 891 | 6/1986 | European Pat. Off. . |
| 0 326 912 | 8/1989 | European Pat. Off. . |
| 2 262 696 | 9/1975 | France . |

*Primary Examiner*—John Sheehan
*Attorney, Agent, or Firm*—Austin R. Miller

[57] ABSTRACT

Method for producing a grain oriented silicon steel sheet comprises heating a silicon steel slab containing about:
C : 0.01 to 0.10 wt %, Si: 2.5 to 4.5 wt %,
Mn: 0.02 to 0.12 wt %, Al: 0.005 to 0.10 wt %,
N : 0.004 to 0.015 wt %, to about 1280° C. or higher and then subjecting it to hot rolling to prepare a hot-rolled steel sheet, subjecting the steel sheet to hot-rolled sheet annealing according to necessity, then subjecting it to one cold-rolling step or two or more cold-rolling steps with interposed intermediate annealing steps to prepare a cold-rolled steel sheet, and subjecting the cold-rolled steel sheet to decarburization annealing and finishing annealing, wherein the finishing rolling terminating temperature of the hot-rolling step is controlled to a range of about 900° to 1100° C., and the rolled sheet is processed so that the steel sheet temperature T(t) (° C.) after time t falling in a range determined by an equation (1) which elapses from the termination of said hot finishing rolling approximately satisfies the equation (2):

$$2 \text{ seconds} \leqq t \leqq 6 \text{ seconds} \quad (1)$$

$$T(t) \leqq FDT-(FDT-700)/6 \times t \quad (2)$$

wherein FDT represents the hot finishing termination temperature (° C.).

4 Claims, 15 Drawing Sheets

PRODUCTION METHOD FOR GRAIN ORIENTED SILICION STEEL SHEET HAVING EXCELLENT MAGNETIC CHARACTERISTICS

BACKGROUND OF THE INVENTION

1. Field of the Invention

The present invention relates to a production method for a grain oriented silicon steel sheet, and specifically to a production method for a grain oriented silicon steel sheet exhibiting low core loss and high magnetic flux density.

2. Description of the Prior Art

Grain oriented silicon steel sheets are primarily utilized as core materials for transformers and various electric appliances. Such applications require core materials which exhibit excellent magnetic characteristics, i.e., high magnetic flux density and low core loss.

Conventional production methods for grain oriented silicon steel sheet involve forming a slab 100 to 300 mm thick, subjecting the slab to hot rolling after heating the slab to 1250° C. or higher to form a hot-rolled sheet; cold rolling the hot-rolled sheet at least once to a final sheet thickness, with intermediate annealing(s) conducted between consecutive cold rollings; finish annealing the cold-rolled sheet for secondary recrystallization and purification, the finishing annealing being performed after subjecting the cold-rolled sheet to decarburization annealing and then applying an annealing separating agent thereon.

That is, after the slab is first heated to high temperatures to completely solubilize inhibitor components, a primary recrystallized grain structure is obtained by hot rolling, cold rolling at least once and annealing at least once, and then primary recrystallized grains are recrystallized to secondary recrystallized crystal grains of a (110) (001) direction by finishing annealing, whereby needed magnetic characteristics are secured.

In order to accelerate secondary recrystallization, it is important to control the deposition of a dispersion phase through an inhibitor. The function of the inhibitor is to inhibit the normal grain growth of primary recrystallized grains so that the dispersion phase is dispersed in the steel in a uniform manner and a suitable size, and to uniformly distribute the primary recrystallized grain structure throughout the sheet thickness at a suitable crystal grain size. Examples of inhibitors include sulfides, selenides and nitrides such as MnS, MnSe, AlN, and VN, and other materials having very small solubility in steel. Further, intergranular segregation type elements such as Sb, Sn, As, Pb, Ce, Cu, and Mo are used as inhibitors.

In order to obtain a good secondary recrystallized structure, it is important to control the deposition of the inhibitor from hot rolling to the subsequent secondary recrystallization annealing. This inhibitor deposition control is important to the realization of excellent magnetic characteristics.

Techniques described in Japanese Patent Publication No. 38-14009, Japanese Patent Application Laid-Open No. 56-33431, Japanese Patent Application Laid-Open No. 59-50118, Japanese Patent Application Laid-Open No. 64-73023, Japanese Patent Application Laid-Open No. 2-263924, Japanese Patent Application Laid-Open No. 2-274811, and Japanese Patent Application Laid-Open No. 5-295442 disclose conventional techniques which control inhibitor deposition by controlling temperature hysteresis from the finishing rolling of the hot rolling step to coiling.

Disclosed in Japanese Patent Publication No. 38-14009 is a production method for grain-oriented silicon electro-steel, comprising subjecting a hot-rolled steel strip of the grain-oriented silicon electro-steel to solution heat treatment at temperatures ranging from 790° C. to 950° C. to maintain carbon in the form of solid solution, quickly quenching the steel strip down to a temperature of 540° C. or less in order to prevent intergranular carbides from being formed, maintaining the steel strip at temperatures of 310° to 480° C. during which lens-shaped deposits appear in the grains, followed by another quenching step, and then repeating cold rolling and annealing alternately in order to form a grain-oriented structure.

In this method, however, an inhibitor component is not added. Thus, this method primarily seeks to control the form of deposited carbide by controlling the cooling rate and the length of time spent in a carbide depositing temperature region (in the vicinity of 700° C.). Accordingly, improved magnetic characteristics have not been realized from the actual application of this technique to the production of a grain oriented electromagnetic steel sheet containing AlN, MnSe and MnS.

Disclosed in Japanese Patent Application Laid-Open No. 56-33431 are a method involving controlling coiling temperatures in a temperature range of 700° to 1000° C., a method involving heating a coil for 10 minutes to 5 hours after coiling at high temperatures of 700° to 1000° C., and a method involving quenching the coil after coiling at high temperatures of 700° to 1000° C.

The technique disclosed in this publication seeks to improve the deposition-dispersion state of AlN as an inhibitor, but heterogeneous decarbonization still occurs due to self-annealing within the coil after coiling, and the subsequent formation of a cold-rolled aggregate structure is unstable, which increases scattering in the characteristics of the product. In particular, water cooling of a coil results in an uneven cooling rate and therefore becomes the primary factor behind the scattering of product characteristics.

Disclosed in Japanese Patent Application Laid-Open No. 59-50118 is a method involving the cooling of a hot-rolled steel strip to temperature ranges calculated from the following equations (a) and (b) at a cooling rate of 7° to 40° C./second after separation from a final finishing stand. The steel strip is then coiled and left to cool. Also disclosed is a method in which a hot-rolled steel strip is cooled to temperatures calculated from the following equation (c) or lower at a cooling rate of 7° to 30° C./second after separation from the final finishing stand. The steel strip is then coiled, followed by further cooling of the coiled steel strip with water. Equations (a), (b) and (c) are as follows:

$$(35\times\log V+515)^\circ\ C. \quad (a)$$

$$(445\times\log V-570)^\circ\ C. \quad (b)$$

$$(20\times\log V+555)^\circ\ C. \quad (c)$$

wherein V represents the cooling rate (° C./second) of the hot-rolled steel strip during the steps of separation from the final finishing stand to coiling.

However, these methods are directed to processes where AlN is not used as an inhibitor, and such methods would be expected to negatively affect the production of a grain oriented electromagnetic steel sheet when using AlN alone or AlN and MnSe compositely.

Disclosed in Japanese Patent Application Laid-Open No. 64-73023 discloses a method involving controlling the average cooling rate from the termination of finishing rolling in the hot rolling step to coiling to 10° C./second or more and less than 40° C./second and controlling the range of coiling temperatures from 550° to 750° C. A method involving controlling the average cooling rate and the coiling temperature to 40° to 80° C./second and 550° to 750° C., respectively, is also disclosed.

As in the methods disclosed in Japanese Patent Application Laid-Open No. 59-50118, these methods utilize MnS and MnSe as inhibitors and do not relate or refer to a production method for a grain oriented electromagnetic steel sheet which utilizes AlN. Further, with respect to the disclosed cooling rates, both of these references consider only the average cooling rates in the steps of from the termination of finishing to coiling. That is, there is no consideration at all of the residence time at high temperatures immediately after the termination of rolling, which markedly affects the deposition state of AlN as an inhibitor or the composite deposition state of AlN and MnSe or MnS.

Further, disclosed in Japanese Patent Application Laid-Open No. 2-263924 is a method in which a silicon steel slab comprising 0.02 to 0.100 wt % of carbon, 2.5 to 4.5 wt % of silicon, a conventional inhibitor component, and the balance of iron and incidental impurities is subjected to hot rolling, cold rolling at a draft of 80% or more, decarburization annealing, and then final finishing annealing without subjecting the steel to hot-rolled sheet annealing to thereby manufacture a grain oriented electromagnetic steel sheet. The hot rolling terminating temperature is controlled to 750° to 1150° C.; the roller sheet is maintained at temperatures of 700° C. or higher for at least one second or more after terminating the hot rolling; and the coiling temperature is controlled to lower than 700° C.

From the viewpoint of production costs, this technique seeks to accelerate recrystallization by maintaining high temperatures after finishing rolling to thereby improve the structure, while omitting hot-rolled sheet annealing. The acceleration of recrystallization after the hot rolling with this technique improves the structure and can omit the annealing of a hot-rolled sheet, but an improved inhibitor deposition state is not obtained. Since the annealing of a hot-rolled sheet is omitted in this technique, inhibitor deposition control is sacrificed.

Further, disclosed in Japanese Patent Application Laid-Open No. 2-274811 is a method in which a slab comprising 0.021 to 0.075 wt % of carbon, 2.5 to 4.5 wt % of silicon, 0.010 to 0.060 wt % of acid soluble Al, 0.0030 to 0.000130 wt % of nitrogen, 0.014 wt % or less of selenium, 0.05 to 0.8 wt % of manganese, and the balance iron and incidental impurities is heated at temperatures of lower than 1280° C. and then is subjected to hot rolling. Subsequently, the hot-rolled sheet is subjected to hot-rolled sheet annealing if necessary and then at least one cold rolling including a final cold rolling at a draft of 80% or more, with intermediate annealings being performed between consecutive cold rollings, if necessary. Then, the cold-rolled sheet is subjected to decarburization annealing and final finishing annealing to complete the production of a grain oriented electromagnetic steel sheet. During the process, the hot rolling terminating temperature is controlled to 750° to 1150° C.; the hot-rolled sheet is maintained at temperatures of 700° C. or higher for at least one second or more after the completion of the hot rolling; and the coiling temperature is controlled to lower than 700° C.

This method seeks to provide, in a production process utilizing low temperature slab heating, accelerated recrystallization by maintaining the rolled sheet at high temperatures after finishing rolling to enhance and stabilize the magnetic characteristics. However, while the solution of AlN is possible with the low temperature slab heating, the solution of MnS and MnSe can not sufficiently be achieved. In particular, in the case where such hot rolling and cold rolling as described above are applied to a production method in which high temperature slab heating is carried out to sufficiently solubilize inhibitors, products having excellent magnetic characteristics can not be produced because of a difference in the deposition states of the inhibitors. That is, since inhibitor control does not occur during low temperature slab heating, products having excellent magnetic characteristics cannot be stably produced.

Further, disclosed in Japanese Patent Application Laid-Open No. 5-295442 is a method in which a steel sheet after hot rolling is subjected to cold rolling at a final cold rolling draft of 80% or more, wherein the relation between the Ti content and the average cooling rate Ta (° C./second) at temperatures of 850° C. or lower and up to 600° C. after emerging from a finishing stand for hot rolling is:

when $Ta \geqq 30°$ C./second and $Ti \leqq 0.003$ weight %, $Ta \geqq -7/3Ti+100$, when $0.003 < Ti \leqq 0.008$ weight %, $Ta \leqq -11/5T+206$, Ta: ° C./sec Ti: $10^{-4}$ weight %.

However, Ti remaining in a product produced by this method forms oxides and nitrides, resulting in core loss age degradation.

Conventional techniques have not considered the heat hysteresis of a steel sheet from the termination of hot finishing rolling up to coiling in order to disperse an inhibitor in steel in an even form and in a suitable size.

Methods for controlling the cooling rate from the termination of hot finishing rolling up to coiling (for example, as disclosed in Japanese Patent Application Laid-Open No. 59-50118) are known. However, this method has not been directed to the control of an inhibitor, but rather to the deposition of fine carbides. Further, known methods for controlling the cooling rate from the termination of hot finishing rolling up to coiling controls only the average cooling rate. In particular, there has been no consideration given to cooling immediately after the completion of hot finishing rolling.

The conventional techniques described above have not achieved the effective deposition control of an inhibitor. This has made it impossible to manufacture through conventional techniques a grain oriented silicon steel sheet which exhibits excellent magnetic flux density and core loss value.

SUMMARY OF THE INVENTION

Accordingly, an object of the present invention is to provide a production technique for a grain oriented silicon steel sheet which is excellent in magnetic characteristics in the case where AlN is used alone and AlN and MnS or MnSe are used compositely as inhibitors.

Detailed investigations on various factors in a hot rolling step made by the present inventors to achieve the object described above have resulted in a finding that good inhibitor distribution can be obtained by controlling cooling hysteresis after the completion of hot finishing rolling to reduce the fraction defective of secondary recrystallization in a product, and high magnetic flux density and low core loss can be achieved.

That is, the present invention relates to a production method for a grain oriented silicon steel sheet having excellent magnetic characteristics, comprising heating a silicon steel slab containing:

C : about 0.01 to 0.10 wt %, Si: about 2.5 to 4.5 wt %, Mn: about 0.02 to 0.12 wt %, Al: about 0.005 to 0.10 wt %, N: about 0.004 to 0.015 wt %, to about 1280° C. or higher and then subjecting it to hot rolling to prepare a hot-rolled steel sheet, subjecting the hot-rolled steel sheet to hot-rolled sheet annealing as needed, then subjecting the hot-rolled steel sheet to cold rolling once or twice or more times and interposing intermediate annealing therebetween to prepare a cold-rolled steel sheet, and subjecting the cold-rolled steel sheet to decarburization annealing and finishing annealing, wherein a finishing rolling terminating temperature in the hot rolling is controlled to a range of about 900° to 1100° C., and the rolled sheet is processed so that a steel sheet temperature T(t) (° C.) after time t falling in a range determined by equation (1) elapsing from the termination of the above hot finishing rolling satisfies equation (2):

$$2 \text{ seconds} \leqq t \leqq 6 \text{ seconds} \quad (1)$$

$$T(t) \leqq FDT-(FDT-700)/6 \times t \quad (2)$$

wherein FDT represents a hot finishing terminating temperature (° C.).

In another embodiment, the present invention relates to a production method for a grain oriented silicon steel sheet having excellent magnetic characteristics, wherein the silicon steel slab used in the first embodiment above further contains at least one selected from Se: about 0.005 to 0.06 wt % and S: about 0.005 to 0.06 wt %.

The cooling rate of the steel sheet in the period of from 6 seconds after the termination of hot finishing rolling up to coiling is preferably controlled to about 25° C./second or less.

Figure 1:
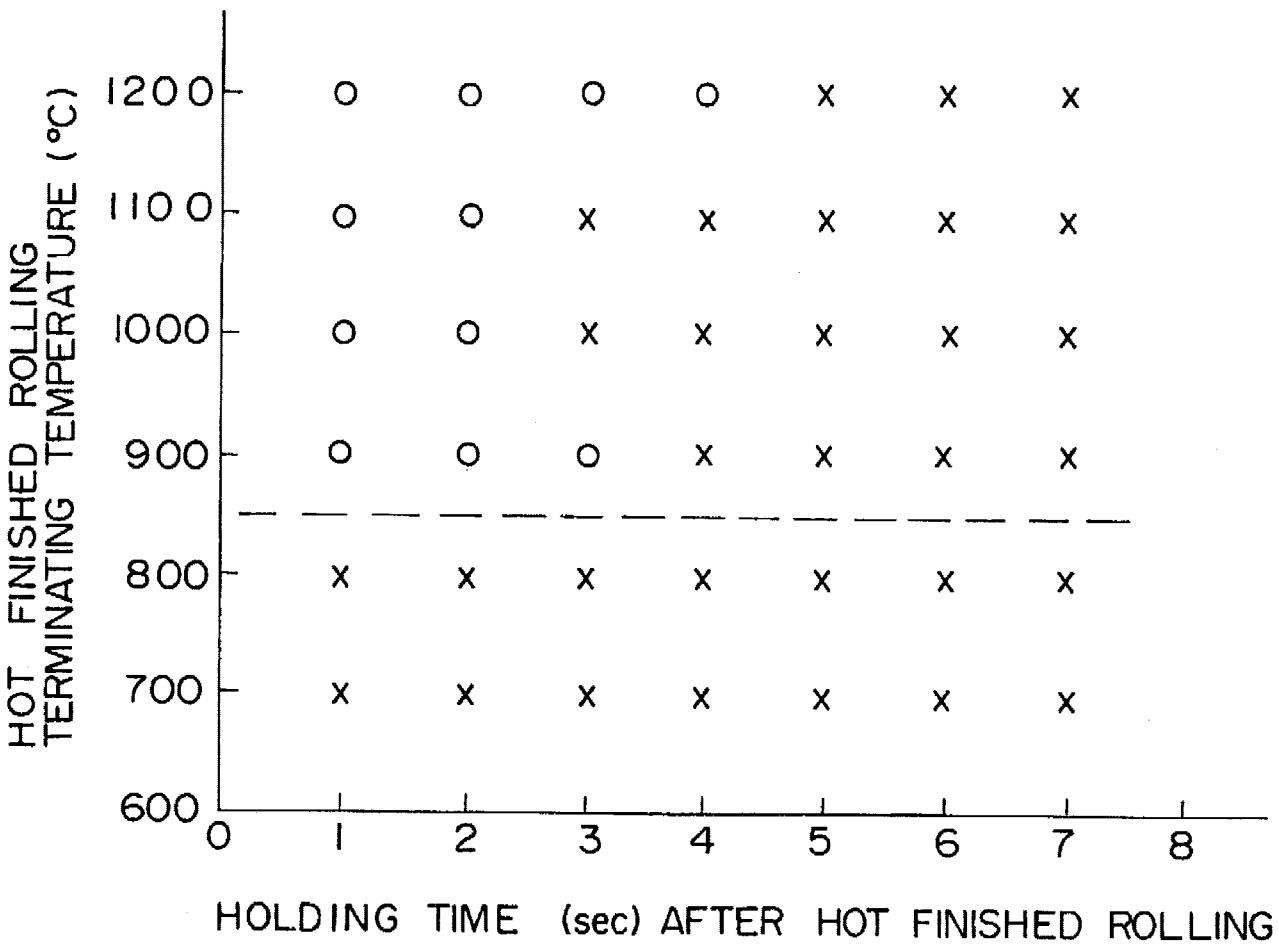
FIG. 1 is a diagram showing the relation of the hot finishing rolling terminating temperature and the holding time after rolling with the magnetic characteristics in Experiment 1.

The experimental results which have lead to the present invention shall be described below.

Experiment 1

First, an experiment was carried out to clarify the influence of the temperature hysteresis of a steel sheet immediately after the completion of hot finishing rolling exerted on the deposition of an inhibitor.

Steel containing C: 0.07 wt %, Si: 3.05 wt %, Mn: 0.06 wt %, Al: 0.020 wt %, and N: 0.0090 wt % was formed into an ingot by vacuum melting and heated again to 1200° C. after casting to roll the ingot to a thickness of 40 mm. After samples of thickness 40 mm × width 300 mm × length 400 mm were obtained and heated at 1300° C. to cause inhibitor components to go into solution, they were subjected to hot rolling to a sheet thickness of 2.3 mm. Hot finishing rolling terminating temperatures (FDT) were controlled to the respective temperatures of 700° to 1200° C., and the rolled sheets were maintained at the temperatures for 1 to 7 seconds. Then, the sheets were quenched, and after holding them in a furnace of 500° C. for one hour, the sheets were cooled in air to room temperature.

After these hot-rolled sheets were subjected to hot-rolled sheet annealing, they were subjected to primary cold rolling and then to intermediate annealing to finish them to a sheet thickness of 0.23 mm by secondary cold rolling. Then, after the sheets were subjected to decarburization annealing at 850° C. for 2 minutes in a wet hydrogen atmosphere, and an annealing separating agent containing MgO as a main component was applied thereon, the sheets were subjected to final finishing annealing at 1200° C. for 10 hours in a hydrogen atmosphere.

The magnetic characteristics of the products thus obtained were investigated. The results thereof are shown in FIG. 1. With the holding time after the termination of hot finishing rolling allotted to the abscissa, and the hot finishing rolling terminating temperature allotted to the ordinate, the magnetisms of the products corresponding to the respective conditions are represented by the symbols of ○ and x. The symbol ○ shows that the magnetism of $B_8$: 1.88 T or more has been obtained, and the symbol x shows that the magnetism of less than $B_8$: 1.88 T has been obtained.

It is clear from the results obtained in Experiment 1 that in order to achieve fine deposition of inhibitors and obtain good magnetism, the hot finishing rolling terminating temperature is about 900° C. or higher in steel sheet temperature hysteresis immediately after the termination of hot finishing rolling. Further, it has been found that high temperature maintenance in the period of from the termination of hot finishing rolling up to about 2 seconds exerts no specific adverse effect on the deposition of inhibitors.

Next, the following experiment was carried out in order to clarify the influence of steel sheet temperature hysteresis after 2 seconds elapsing since the termination of hot finishing rolling.

Experiment 2

Figure 2:
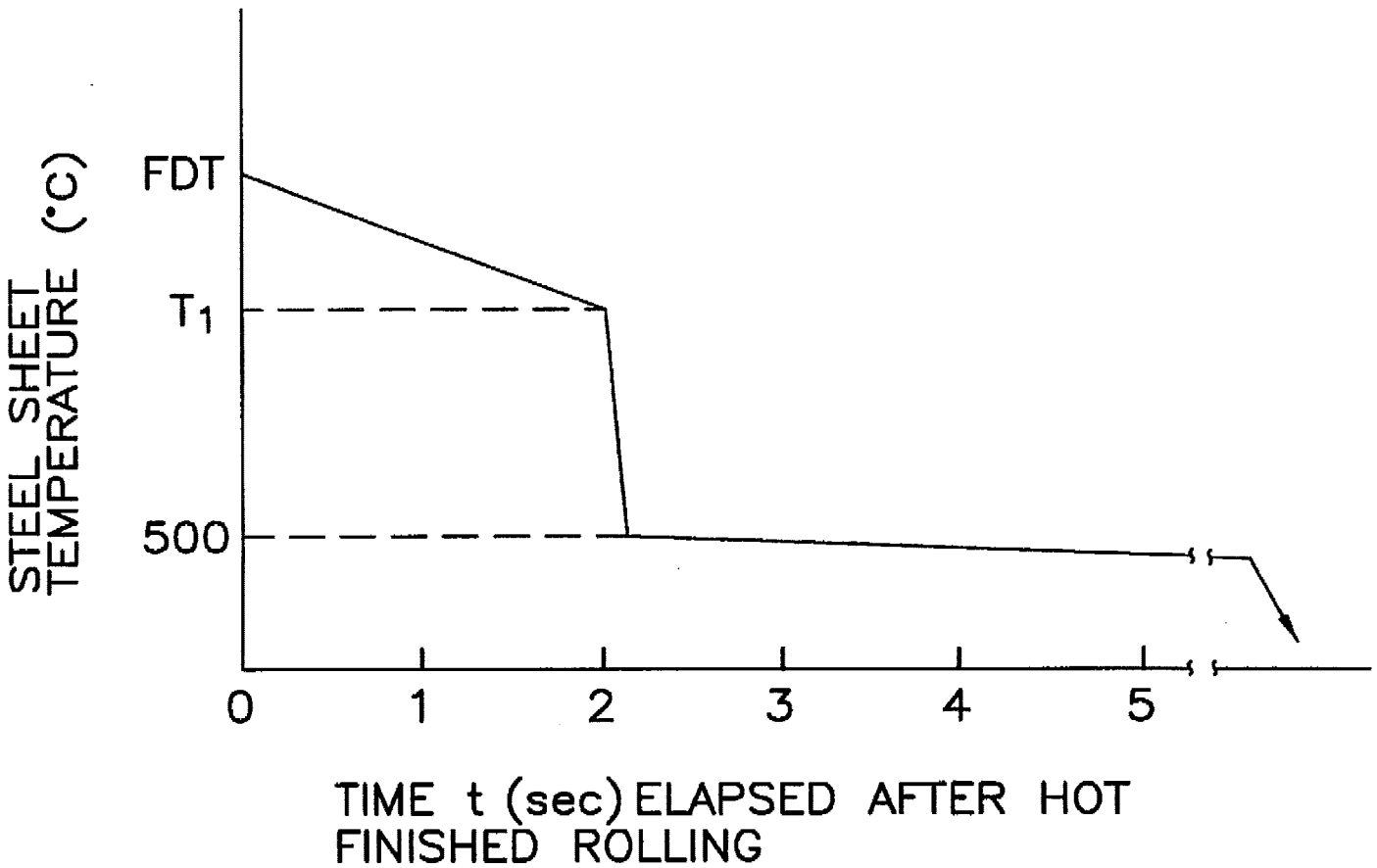
FIG. 2 is a graph showing the temperature of the steel sheet after the completion of hot finishing rolling in Experiment 2.

Steel containing C: 0.08 wt %, Si: 3.20 wt %, Mn: 0.05 wt %, Al: 0.025 wt %, and N: 0.0085 wt % was formed into an ingot by vacuum melting and heated again to 1200° C. after casting to roll the ingot to a thickness of 40 mm. After samples of thickness 40 mm × width 300 mm × length 400 mm were obtained and heated at 1300° C. to cause inhibitor components to go into solution, they were subjected to hot rolling to a sheet thickness of 2.3 mm. Hot finishing rolling terminating temperatures (FDT) were controlled to 900° C., 1000° C. and 1100° C., and 2 seconds later, the rolled sheets were cooled down so that they reached the respective temperatures ($T_1$) of less than respective hot finishing rolling terminating temperatures and 800° C. or higher. Then, the sheets were quenched, and after holding in a furnace of 500° C. for one hour, the sheets were cooled in air to room temperature. These temperatures are shown in FIG. 2.

After these hot rolled sheets were subjected to hot-rolled sheet annealing, they were subjected to primary cold rolling and then to intermediate annealing to finish them to a sheet thickness of 0.23 mm by secondary cold rolling. Then, after the sheets were subjected to decarburization annealing at 850° C. for 2 minutes in a wet hydrogen atmosphere, and an annealing separating agent containing MgO as a main component was applied thereon, the sheets were subjected to final finishing annealing at 1200° C. for 10 hours in a hydrogen atmosphere.

Figure 3:
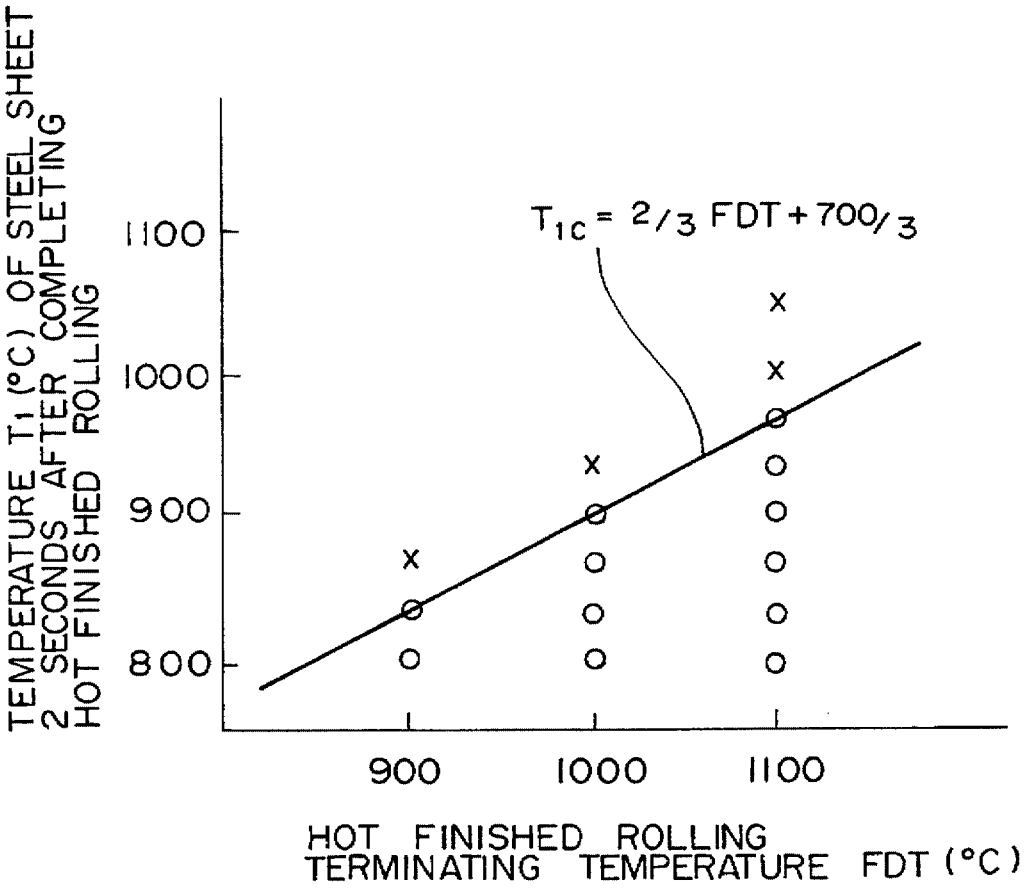
FIG. 3 is a graph showing the relation of the hot finishing rolling terminating temperature and the temperature ($T_1$) after 2 seconds elapsing since the completion of the hot finishing rolling with the magnetic characteristics in Experiment 2.

The magnetic characteristics of the products thus obtained were investigated. The results thereof are shown in FIG. 3.

The maximum temperature ($T_{1C}$) providing good magnetism varies depending on the hot finishing rolling terminating temperature. $T_{1c}$ satisfies the equation (3) as shown by the line in FIG. 3:

$$T_{1C}=\tfrac{2}{3}\times FDT+700/3 \quad (3)$$

Experiment 3

Steel containing C: 0.04 wt %, Si: 3.00 wt %, Mn: 0.06 wt %, Al: 0.03 wt %, and N: 0.0090 wt % was formed into an ingot by vacuum melting and heated again to 1200° C. after casting to roll the ingot to a thickness of 40 mm. After samples of thickness 40 mm × width 300 mm × length 400 mm were obtained from this and heated at 1300° C. to cause inhibitor components to go into solution, they were subjected to hot rolling to a sheet thickness of 2.3 mm. Hot finishing rolling terminating temperatures (FDT) were controlled to 900° C., 1000° C. and 1100° C., and 2 seconds later, the rolled sheets were continuously cooled down to $T_{1C}$ corresponding to the finishing rolling terminating temperatures and further continuously cooled down to $T_2$° C. in Δt seconds. Then, the sheets were quenched, and after holding them in a furnace of 500° C. for one hour, the sheets were cooled in air to room temperature. These temperatures are shown in FIG. 4.

After these hot-rolled sheets were subjected to hot-rolled sheet annealing, they were subjected to primary cold rolling and then to intermediate annealing to finish them to a sheet thickness of 0.23 mm by secondary cold rolling. Then, after the sheets were subjected to decarburization annealing at 850° C. for 2 minutes in a wet hydrogen atmosphere, and an annealing separating agent containing MgO as a main component was applied thereon, the sheets were subjected to final finishing annealing at 1200° C. for 10 hours in a hydrogen atmosphere.

The magnetic characteristics of the products thus obtained were investigated. The results thereof are shown in FIG. 5 to FIG. 7.

Figure 4:
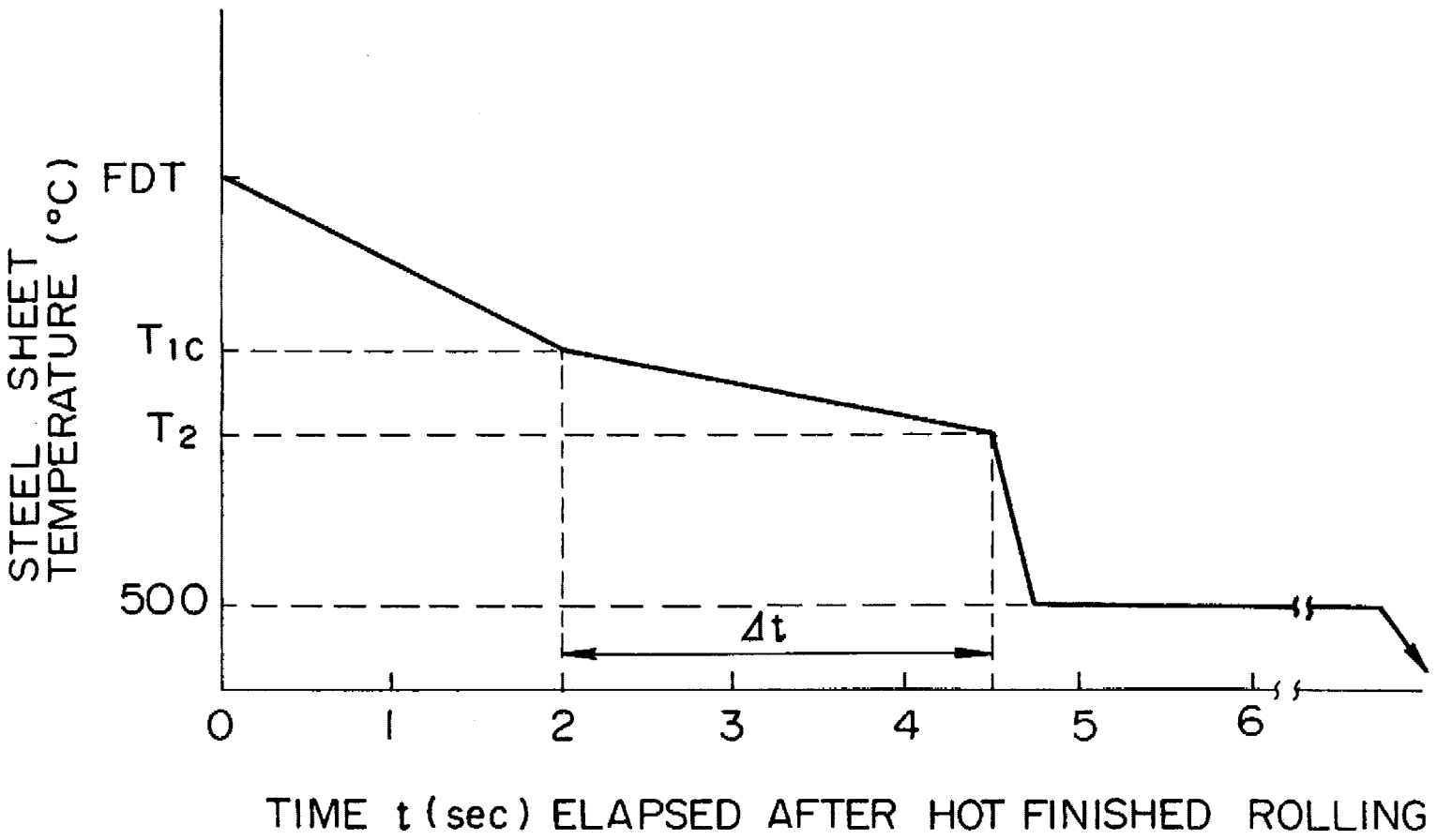
FIG. 4 is a graph showing the temperature of the steel sheet after the completion of hot finishing rolling in Experiment 3.
Figure 5:
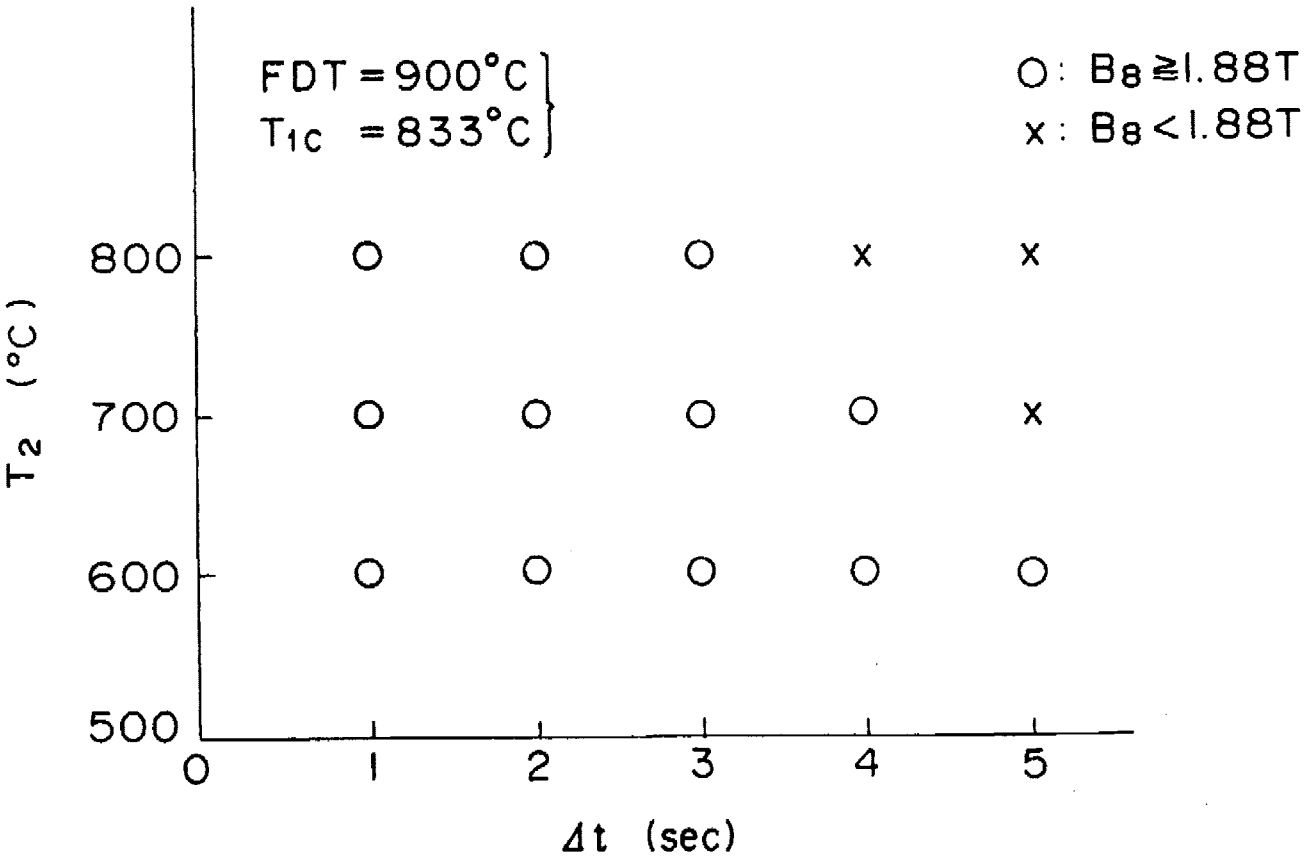
FIG. 5 is a diagram showing the relation of time Δt elapsing for reaching the temperature ($T_2$) in terminating cooling from $T_1$ after the completion of hot finishing rolling and $T_2$ with the magnetic characteristics in Experiment 3.
Figure 6:
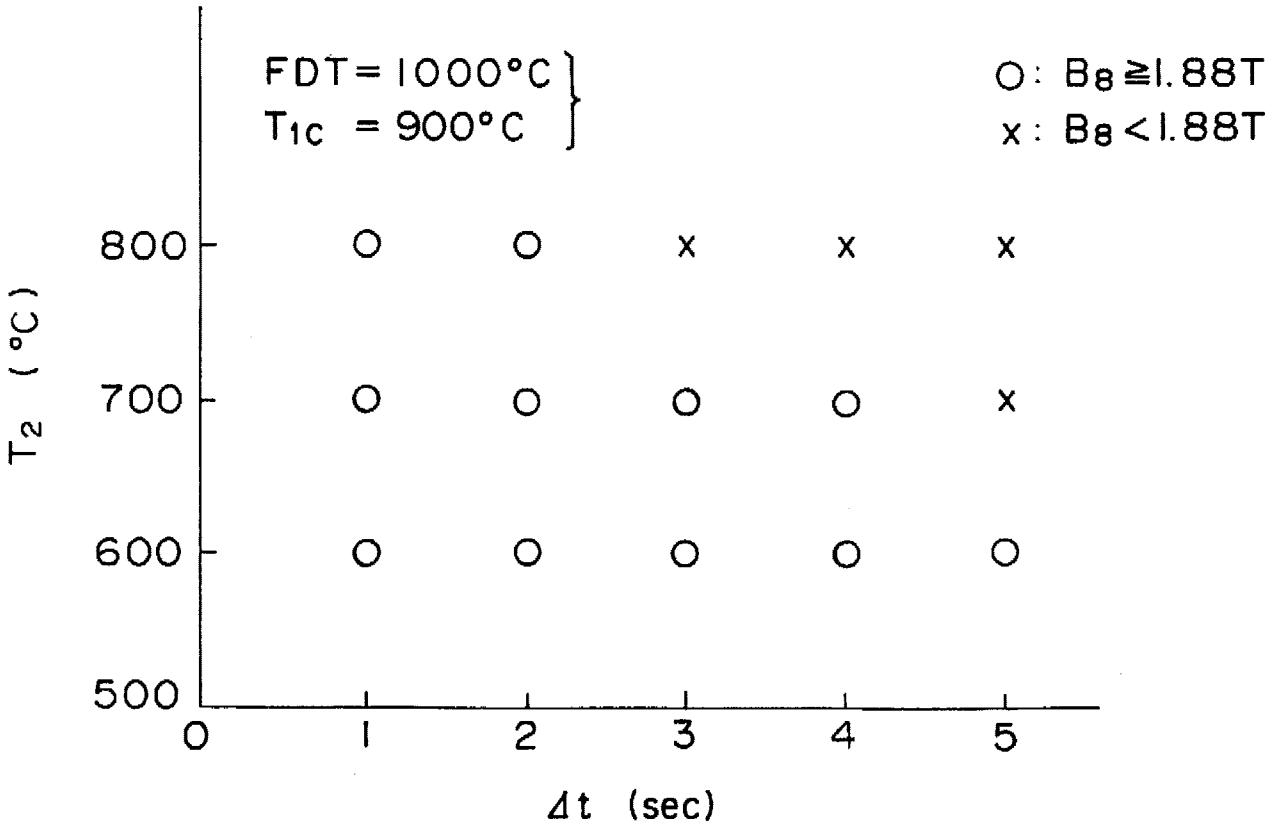
FIG. 6 is a diagram showing the relation of time Δt elapsing for reaching the temperature ($T_2$) in terminating cooling from $T_1$ after the completion of hot finishing rolling and $T_2$ with the magnetic characteristics in Experiment 3.
Figure 7:
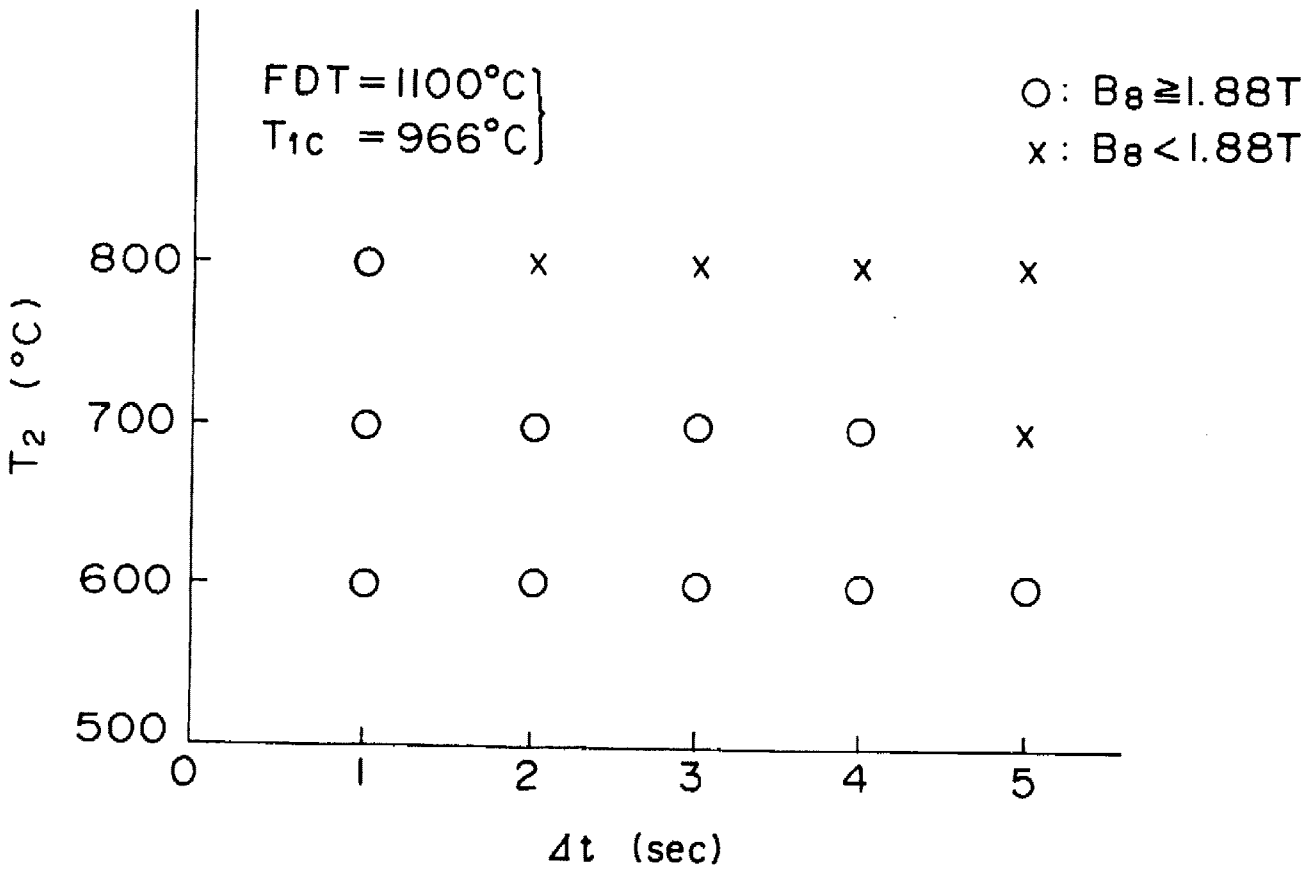
FIG. 7 is a diagram showing the relation of time Δt elapsing for reaching the temperature ($T_2$) in terminating cooling from $T_1$ after the completion of hot finishing rolling and $T_2$ with the magnetic characteristics in Experiment 3.

All of FIG. 5 to FIG. 7 are diagrams showing the relation of time Δt in which the steel sheet temperature reaches $T_2$ from $T_{1C}$ shown in FIG. 4 after the termination of hot finishing rolling and the steel sheet temperature $T_2$ with the magnetic characteristics, wherein FDT=900° C. and $T_{1C}$=833° C. in FIG. 5; FDT=1000° C. and $T_{1C}$=900° C. in FIG. 6; and FDT=1100° C. and $T_{1C}$=966° C. in FIG. 7.

In FIG. 5 to FIG. 7, the symbol ○ shows that the magnetism of $B_8$: 1.88 T or more was obtained, and the symbol x shows that the magnetism of less than $B_8$: less than 1.88 T was obtained.

It can be found from FIG. 5 to FIG. 7 that Δt is Δt≦4 seconds (6 seconds after the termination of hot finishing rolling) regardless of FDT and that if $T_2$≦700° C., good magnetic characteristics were obtained.

It can be concluded from the results obtained in Experiments 2 and 3 that it is a necessary condition to reduce the temperature to $T_{1C}$ or lower in about 2 seconds after the termination of hot finishing rolling and reduce it about 700° C. or lower in about 6 seconds after termination of hot rolling.

Next, an influence exerted by the manner of cooling in the period of from 2 seconds after the termination of hot finishing rolling up to 6 seconds was investigated.

Experiment 4

Figure 8:
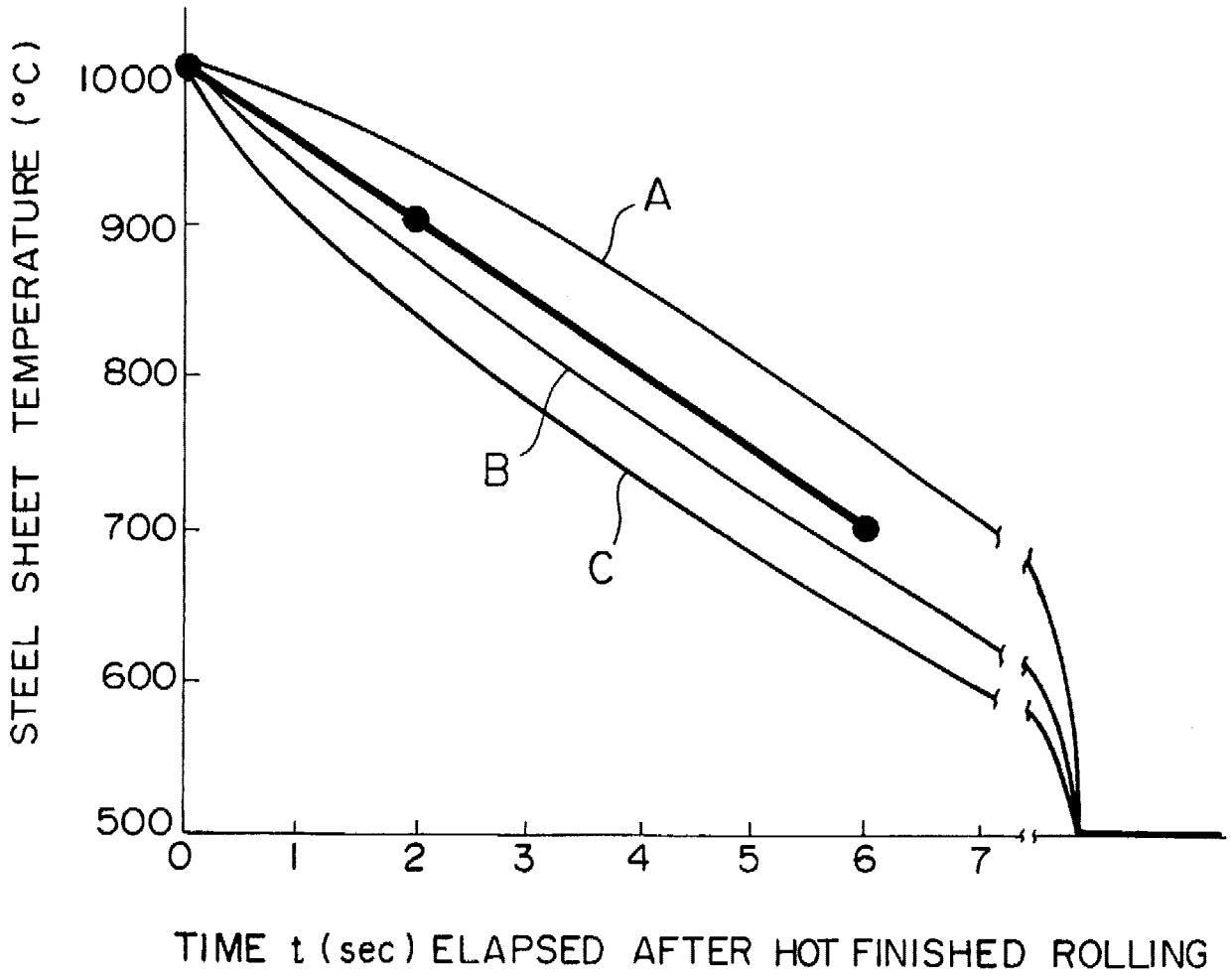
FIG. 8 is a graph showing the temperature of the steel sheet after the completion of hot finishing rolling in Experiment 4.
Figure 9:
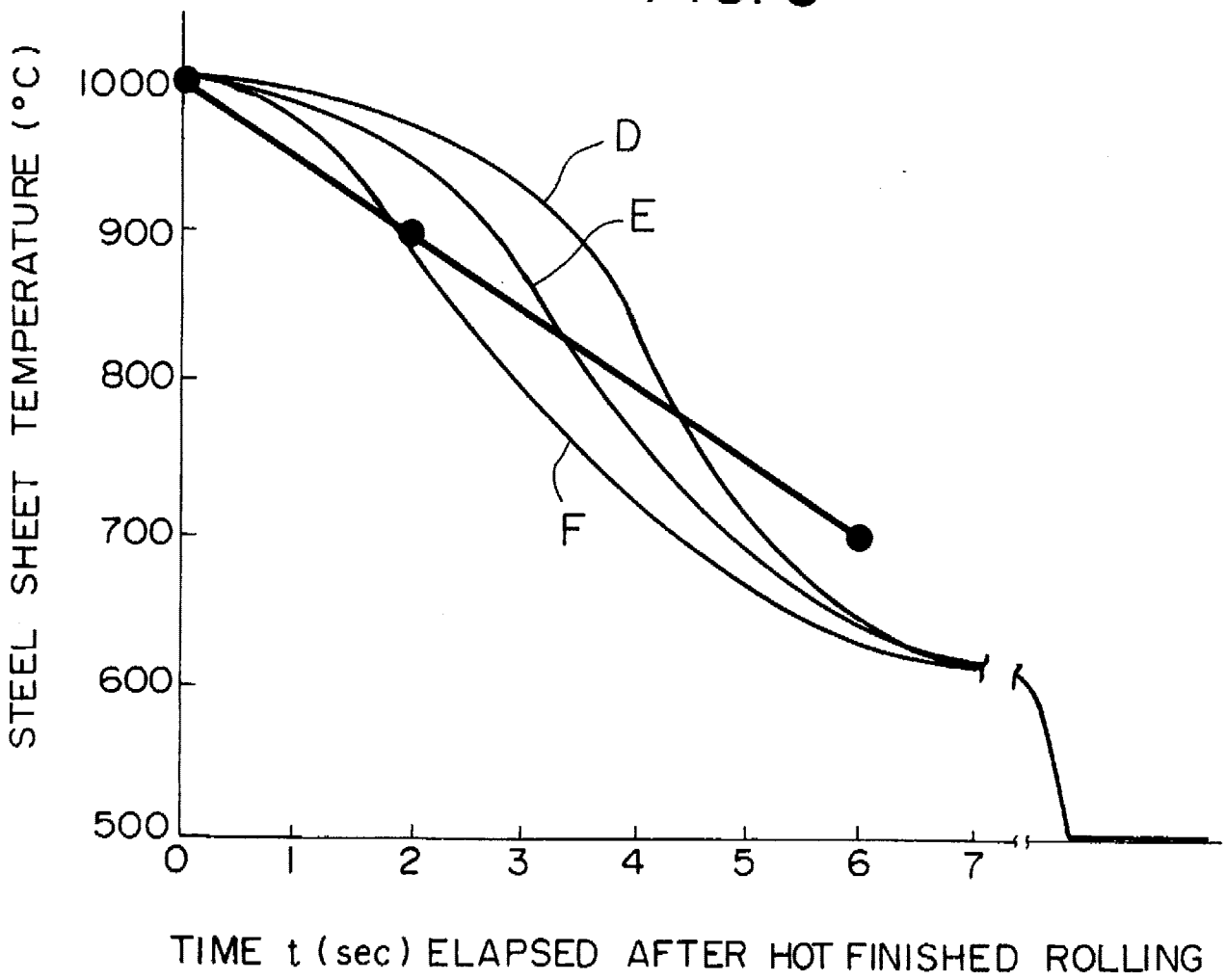
FIG. 9 is a graph showing the temperature of the steel sheet after the completion of hot finishing rolling in Experiment 4.
Figure 10:
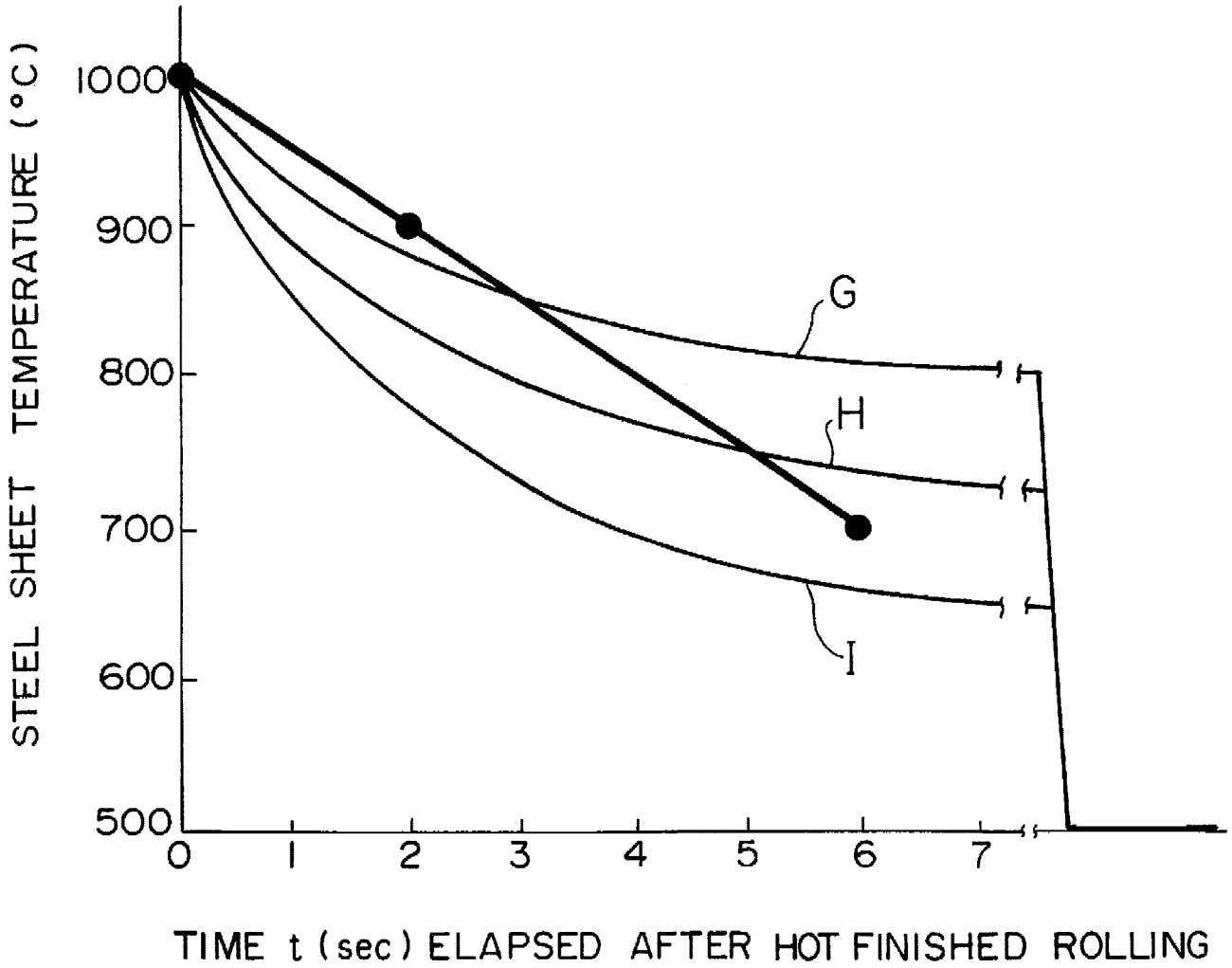
FIG. 10 is a graph showing the temperature of the steel sheet after the completion of hot finishing rolling in Experiment 4.

Steel containing C: 0.05 wt %, Si: 2.95 wt %, Mn: 0.061 wt %, Al: 0.023 wt %, and N: 0.0085 wt % was formed into an ingot by vacuum melting and heated again to 1200° C. after casting to roll the ingot to a thickness of 40 mm. After samples of thickness 40 mm × width 300 mm × length 400 mm were obtained from this and heated at 1300° C. to cause inhibitor components to go into solution, they were subjected to hot rolling to a sheet thickness of 2.3 mm. The cooling conditions in the period of from the termination of hot finishing rolling up to 6 seconds are shown in FIG. 8 to FIG. 10, wherein the hot finishing rolling terminating temperature (FDT) was set to 1000° C. Straight lines connecting the point of terminating the hot finishing rolling, the point of $T_{1C}$° C. in 2 seconds after terminating the hot finishing rolling, and the point of 700° C. in 6 seconds after terminating the hot finishing rolling are shown by a heavy line. This heavy line is represented by the following equation (4):

$$T(t)=FDT-(FDT-700)/6\times t \quad (4)$$

t : time elapsing since terminating the hot finishing rolling, and

T(t): steel sheet temperature in t seconds.

Then, the rolled sheets were quenched, and after holding them in a furnace of 500° C. for one hour, the sheets were cooled in air to room temperature.

After these hot-rolled sheets were subjected to hot-rolled sheet annealing, they were subjected to primary cold rolling and then to intermediate annealing to finish them to a sheet thickness of 0.23 mm by secondary cold rolling. Then, after the sheets were subjected to decarburization annealing at 850° C. for 2 minutes in a wet hydrogen atmosphere, and an annealing separating agent containing MgO as a main component was applied thereon, the sheets were subjected to final finishing annealing at 1200° C. for 10 hours in a hydrogen atmosphere.

The magnetic characteristics of the products thus obtained were investigated. The results thereof are shown in Table 1. The secondary recrystallization-generating area rate defective means a rate of an area occupied by crystal grains having a diameter of 2 mm or less in a product sheet after finishing annealing.

It has been found from the results obtained in Experiment 4 that if the equation:

$$T(t) \leqq FDT-(FDT-700)/6\times t$$

is satisfied in about 2 to 6 seconds after the termination of the hot finishing rolling, good magnetic characteristics can be obtained.

TABLE 1

| | Magnetic characteristics | | Secondary recrystallization-generating area | |
|---|---|---|---|---|
| No. | $B_8$(T) | $W_{17/50}$(W/kg) | rate defective (%) | Remarks |
| A | 1.80 | 0.93 | 18 | Comparative example |
| B | 1.90 | 0.87 | <1 | Example of this invention |
| C | 1.92 | 0.88 | <1 | Example of this invention |
| D | 1.84 | 0.95 | 12 | Comparative example |
| E | 1.83 | 0.96 | 13 | Comparative example |
| F | 1.89 | 0.86 | <1 | Example of this invention |
| G | 1.81 | 0.92 | 13 | Comparative example |
| H | 1.83 | 0.93 | 11 | Comparative example |
| I | 1.93 | 0.84 | <1 | Example of this invention |

Figure 11:
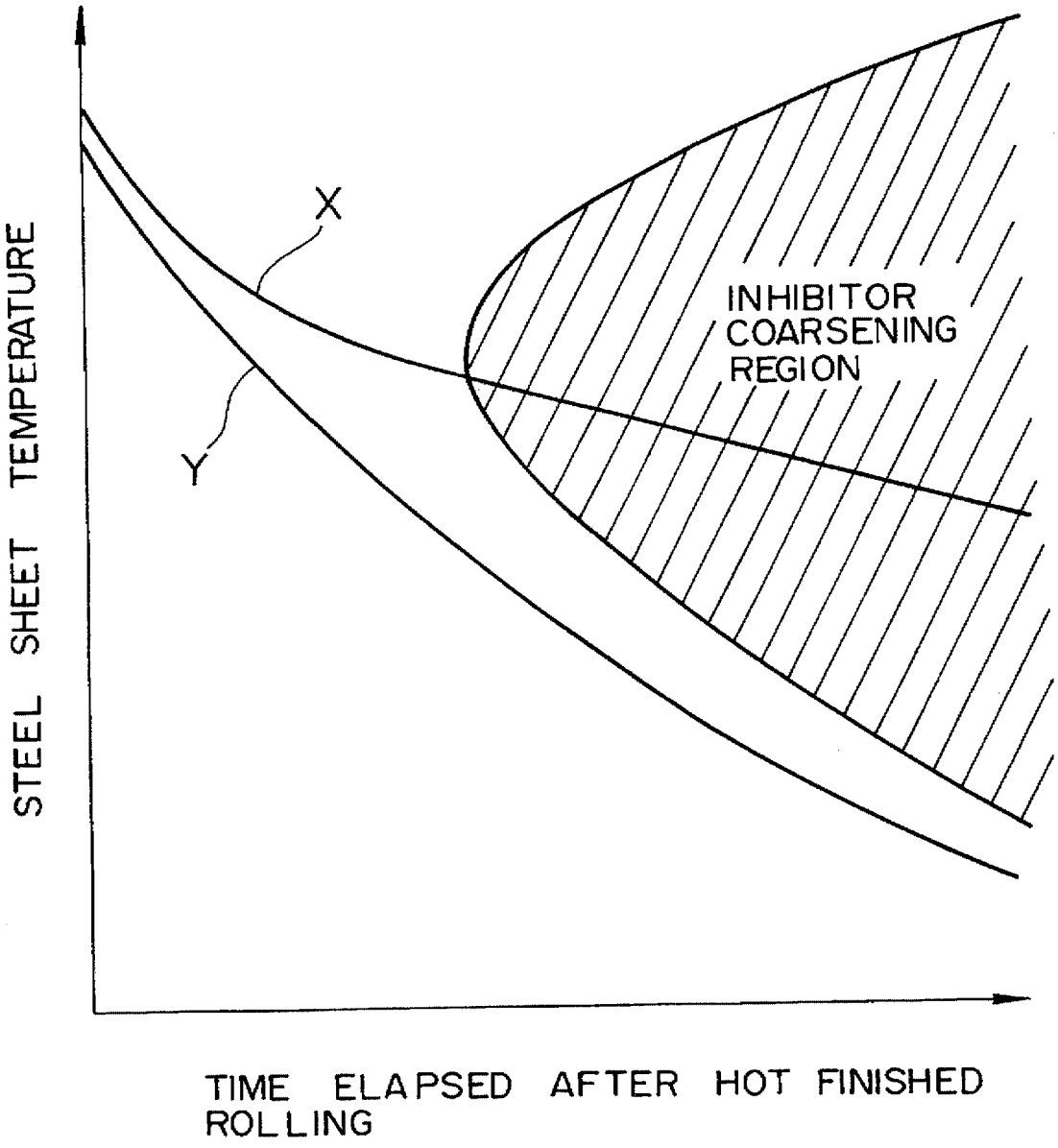
FIG. 11 is a graph showing the influence of steel sheet heat hysteresis based on steel sheet temperature after hot finishing rolling, which is exerted on the deposition state of an inhibitor.

This phenomenon is believed to occur for the following reasons:

The influence of steel sheet heat hysteresis after hot finishing rolling exerted on the deposition state of an inhibitor is graphically shown in FIG. 11.

Inhibitors are coarsened after some latent time elapses after the termination of hot finishing rolling. The larger the draft is, or when the drafts are the same, the lower the hot finishing rolling terminating temperature is, the shorter this latent period is. Further, the higher the temperature is, the faster the coarsening proceeds.

Accordingly, the coarse inhibitor is formed in the hatched region shown in FIG. 11. When the steel sheet follows the heat hysteresis shown by X in the drawing and passes through the hatching region, the coarse inhibitor is markedly formed. As a result thereof, secondary recrystallization becomes instable, and the magnetic characteristics are deteriorated. Since in the heat hysteresis shown by Y in the drawing, the steel sheet does not pass through the inhibitor-coarsened region, the inhibitor is not coarsened and, therefore, good magnetic characteristics can be obtained.

It has been found from Experiment 2 that in order to prevent steel sheets from passing through the hatched region in FIG. 11, it is necessary that the steel sheet temperature T(2) satisfies:

$$T(2) \leqq 2/3\times FDT+700/3$$

and from Experiment 3 that the steel sheet is cooled down to about 700° C. or lower in about 6 seconds. These were confirmed by Experiment 4.

Next, a case where MnSe and MnS other than AlN were contained as an inhibitor was investigated.

Experiment 5

The steel having a composition shown in Table 2 was formed into an ingot by vacuum melting and heated again to 1200° C. after casting to roll the ingot to a thickness of 40 mm. After samples of thickness 40 mm × width 300 mm × length 400 mm were obtained from this and heated at 1300° C. to cause inhibitor components to go into solution, they were subjected to hot rolling to a sheet thickness of 2.3 mm. The hot finishing rolling terminating temperatures were controlled to 1100° C. to 900° C., and the cooling conditions in the steps of from the termination of hot finishing rolling up to 6 seconds were controlled so that they became the same as a part of the cooling patterns shown in FIG. 8 to FIG. 10. Then, the sheets were quenched, and after holding them in a furnace of 500° C. for one hour, the sheets were cooled in air to room temperature.

After these hot-rolled sheets were subjected to hot-rolled sheet annealing, they were subjected to primary cold rolling and then to intermediate annealing to finish them to a sheet thickness of 0.23 mm by secondary cold rolling. Then, after the sheets were subjected to decarburization annealing at 850° C. for 2 minutes in a wet hydrogen atmosphere, and an annealing separating agent containing MgO as a main component was applied thereon, the sheets were subjected to final finishing annealing at 1200° C. for 10 hours in a hydrogen atmosphere.

TABLE 2

| | C | Si | Mn | Al | N | Se | S |
|---|---|---|---|---|---|---|---|
| Steel 1 | 0.062 | 3.20 | 0.071 | 0.029 | 0.0094 | 0.017 | — |
| Steel 2 | 0.062 | 3.18 | 0.072 | 0.031 | 0.0093 | — | 0.010 |
| Steel 3 | 0.060 | 3.19 | 0.070 | 0.031 | 0.0094 | 0.010 | 0.008 |

The magnetic characteristics of the products thus obtained were investigated. The results thereof are shown in Table 3. Differences (ΔB, ΔW) from the results obtained by the same cooling pattern as that in Experiment 4 are shown together in Table 3.

According to the results shown in Table 3, it has been found that when Se and S are contained at the same time, the equation:

$$T(t) \leqq FDT-(FDT-700)/6\times t$$

is satisfied in 2 to 6 seconds after the termination of the hot finishing rolling as was the case with the results obtained in Experiment 4, good magnetic characteristics can be obtained. This is because MnSe or MnS other than AlN functions as inhibitors.

TABLE 3

| No. | Kind of steel | Cooling pattern | Magnetic characteristics $B_8$(T) | Magnetic characteristics $W^{17/50}$(W/kg) | Magnetic characteristics difference ΔB | Magnetic characteristics difference ΔW | Secondary recrystallization-generating percent defective (%) | Remarks |
|---|---|---|---|---|---|---|---|---|
| 1 | Steel 1 | A | 1.80 | 0.93 | ±0 | ±0 | 16 | Comparative example |
| 2 | Steel 1 | B | 1.92 | 0.85 | +0.02 | −0.02 | <1 | Example of this invention |
| 3 | Steel 1 | C | 1.94 | 0.86 | +0.02 | −0.02 | <1 | Example of this invention |
| 4 | Steel 1 | D | 1.84 | 0.95 | ±0 | ±0 | 14 | Comparative example |
| 5 | Steel 2 | D | 1.83 | 0.96 | −0.01 | +0.01 | 16 | Comparative example |
| 6 | Steel 2 | E | 1.14 | 0.95 | +0.01 | −0.01 | 13 | Comparative example |
| 7 | Steel 2 | F | 1.93 | 0.85 | +0.04 | −0.01 | <1 | Example of this invention |
| 8 | Steel 2 | I | 1.94 | 0.82 | +0.01 | −0.02 | <1 | Example of this invention |
| 9 | Steel 3 | G | 1.80 | 0.94 | −0.01 | +0.02 | 21 | Comparative example |
| 10 | Steel 3 | H | 1.83 | 0.92 | ±0 | −0.01 | 17 | Comparative example |
| 11 | Steel 3 | I | 1.95 | 0.82 | +0.02 | −0.02 | <1 | Example of this invention |
| 12 | Steel 3 | F | 1.91 | 0.84 | +0.02 | −0.02 | <1 | Example of this invention |

Next, the influence of a cooling rate in the latter half in the steps of from the termination of hot finishing rolling up to coiling was investigated.

Experiment 6

The steel having a composition shown in Table 4 was formed into an ingot by vacuum melting and heated again to 1200° C. after casting to roll the ingot to a thickness of 40 mm. The steel 7 had the same composition as that of the steel obtained in Experiment 4. After samples of thickness 40 mm × width 300 mm × length 400 mm were obtained from this and heated at 1300° C. to cause inhibitor components to go into solution, they were subjected to hot rolling to a sheet thickness of 2.3 mm. The hot finishing rolling terminating temperatures were controlled to 1100° C. to 900° C., and the cooling conditions in the period of from the termination of hot finishing rolling up to 6 seconds were controlled so that they became the same as a part of the cooling patterns shown in FIG. 8 to FIG. 10. The steel sheet was cooled at a cooling rate of 10 to 35° C./sec from the above temperature range down to 500° C. Then, after holding them in a furnace of 500° C. for one hour, the sheets were cooled in air to room temperature.

After these hot-rolled sheets were subjected to hot-rolled sheet annealing, they were subjected to primary cold rolling and then to intermediate annealing to finish them to a sheet thickness of 0.23 mm by secondary cold rolling. Then, after the sheets were subjected to decarburization annealing at 850° C. for 2 minutes in a wet hydrogen atmosphere, and an annealing separating agent containing MgO as a main component was applied thereon, the sheets were subjected to final finishing annealing at 1200° C. for 10 hours in a hydrogen atmosphere.

TABLE 4

| | C | Si | Mn | Al | N | Se | S |
|---|---|---|---|---|---|---|---|
| Steel 4 | 0.052 | 2.95 | 0.060 | 0.022 | 0.0084 | 0.015 | — |
| Steel 5 | 0.051 | 2.95 | 0.061 | 0.021 | 0.0081 | — | 0.012 |
| Steel 6 | 0.050 | 2.96 | 0.059 | 0.022 | 0.0083 | 0.011 | 0.009 |
| Steel 7 | 0.051 | 2.95 | 0.061 | 0.023 | 0.0085 | — | — |

Figure 12:
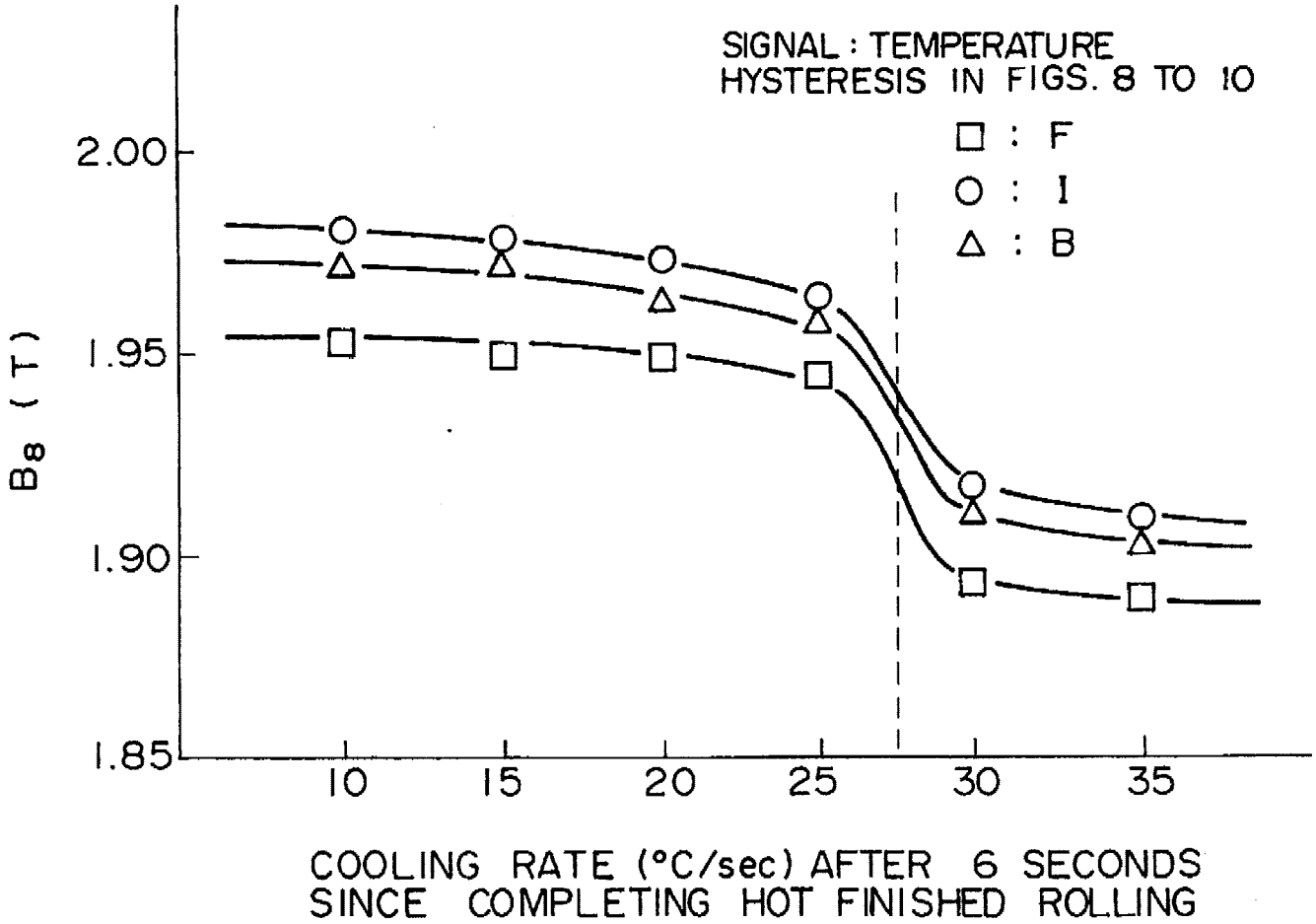
FIG. 12 is a graph showing the relation of the temperature hysteresis in the period of from the completion of hot finishing rolling up to 6 seconds and the cooling rate after 6 seconds elapsing since the termination of the hot finishing rolling with the magnetic characteristics, wherein the steel 4 is used as a sample steel in Experiment 6.

The magnetic characteristics of the products thus obtained were investigated. FIG. 12 is a graph showing the influence exerted on the magnetic characteristics by a cooling rate after 6 seconds elapsing since the termination of hot finishing rolling in the steel 4. In a cooling pattern in the period of from the termination of hot finishing rolling up to 6 seconds, identical are ○ to I in FIG. 10, Δ to B in FIG. 8, and □ to F in FIG. 9.

Figure 13:
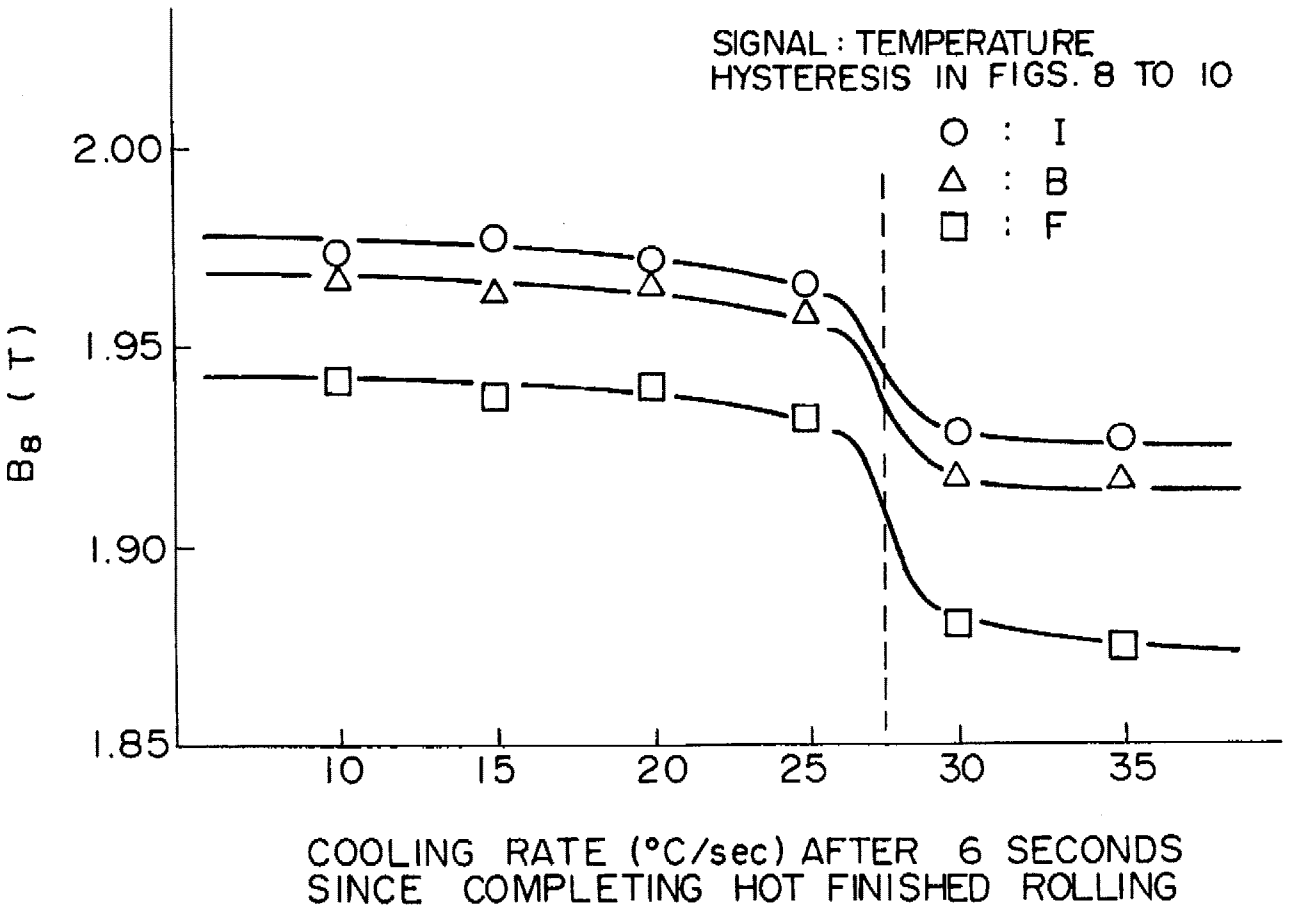
FIG. 13 is a graph showing the relation of the temperature hysteresis in the period of from the completion of hot finishing rolling up to 6 seconds and the cooling rate after 6 seconds elapsing since the termination of the hot finishing rolling with the magnetic characteristics, wherein the steel 5 is used as a sample steel in Experiment 6.

FIG. 13 is a graph showing the influence exerted on the magnetic characteristics by a cooling rate after 6 seconds elapsing since the termination of hot finishing rolling in the steel 5. In a cooling pattern in the period of from the termination of hot finishing rolling up to 6 seconds, identical are ○ to I in FIG. 10, Δ to B in FIG. 8, and □ to F in FIG. 9.

Figure 14:
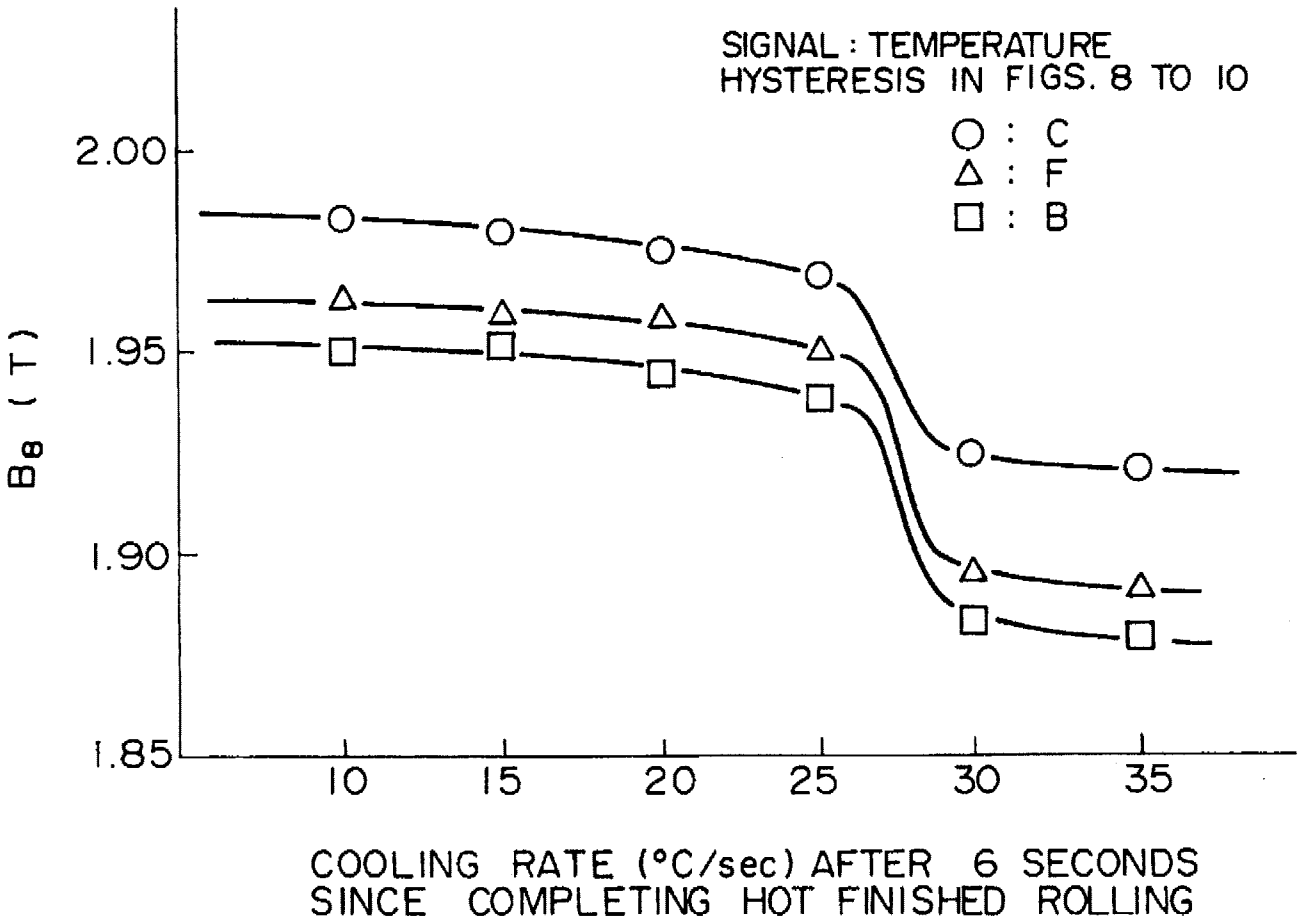
FIG. 14 is a graph showing the relation of the temperature hysteresis from the completion of hot finishing rolling up to 6 seconds and the cooling rate after 6 seconds elapsing since the termination of the hot finishing rolling with the magnetic characteristics, wherein the steel 4 is used as a sample steel in Experiment 6.

FIG. 14 is a graph showing the influence exerted on the magnetic characteristics by a cooling rate after 6 seconds elapsing since the termination of hot finishing rolling in the steel 6. In a cooling pattern in the period of from the termination of hot finishing rolling up to 6 seconds, identical are ○ to C in FIG. 8, Δ to F in FIG. 9, and □ to B in FIG. 8.

Figure 15:
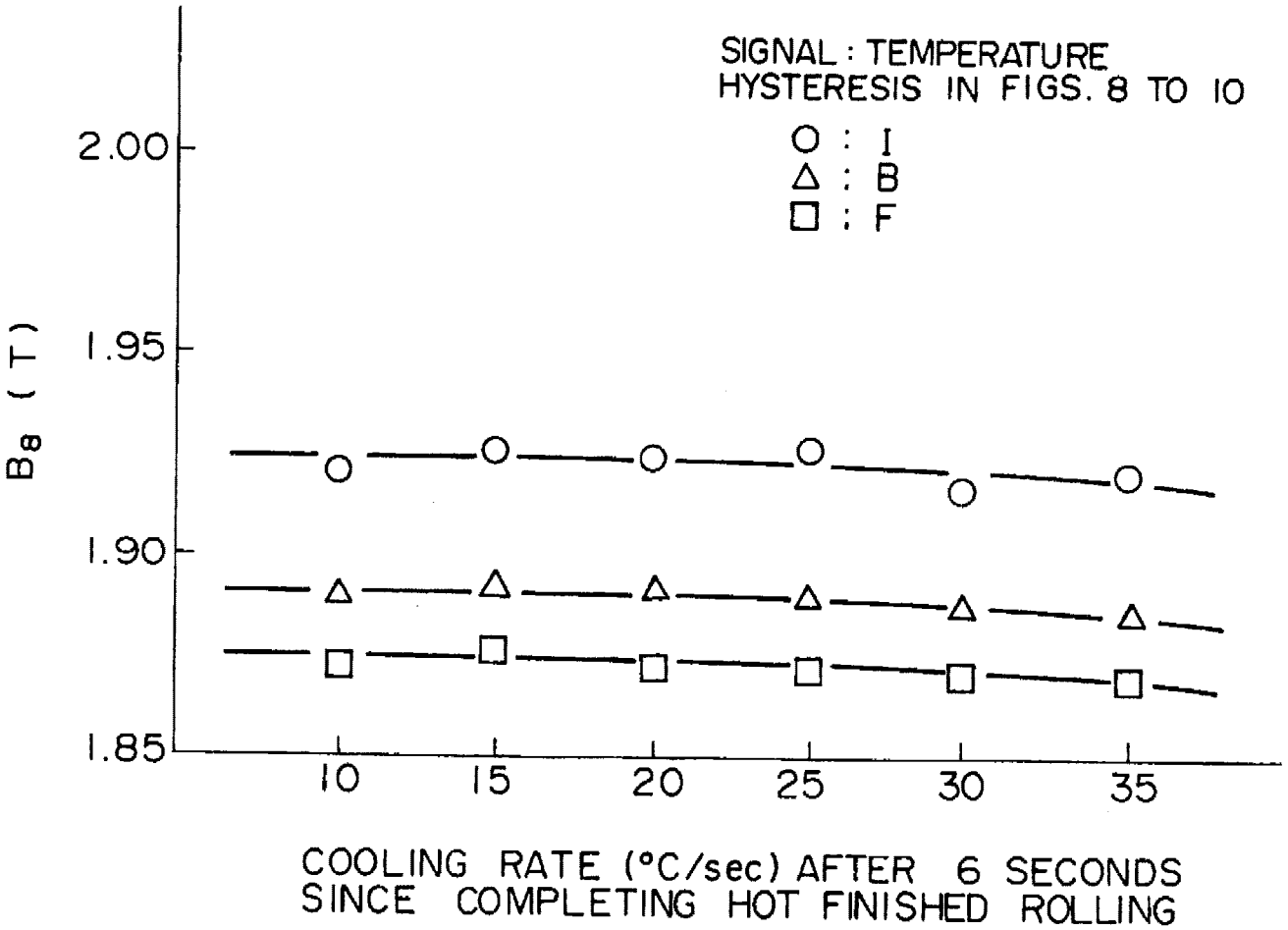
FIG. 15 is a graph showing the relation of the temperature hysteresis in the period from the completion of hot finishing rolling up to 6 seconds and the cooling rate after 6 seconds elapsing since the termination of the hot finishing rolling with the magnetic characteristics, wherein the steel 4 is used as a sample steel in Experiment 6.

FIG. 15 is a graph showing the influence exerted on the magnetic characteristics by a cooling rate after 6 seconds elapsing since the termination of hot finishing rolling in the steel 7. In a cooling pattern in the period of from the termination of hot finishing rolling up to 6 seconds, identical are ○ to I in FIG. 10, Δ to B in FIG. 8, and □ to F in FIG. 9.

According to the results shown in FIG. 12 to FIG. 14, it can be found that when Se or S is contained, or Se and S are contained together, the magnetic flux densities are enhanced by controlling the cooling rate in a range of about 700 to 500° C. to about 10 to 25° C./sec. On the other hand, according to the results shown in FIG. 15, the effect of the cooling rate exerted by the single addition of AlN was not particularly observed.

The phenomenon of why the magnetic characteristics are enhanced when Se or S other than AlN is contained, or Se and S are contained together is believed to occur for the following reasons. MnSe and MnS are deposited in the former stage of hot finishing rolling. After terminating the finishing rolling, AlN is preferentially deposited on MnSe or MnS already deposited to form a composite deposit. In this case, if the cooling rate is slow, the composite deposit stabilizes and becomes a stronger inhibitor. Such effect is not observed in case of AlN alone.

In the present invention, the respective steps such as hot rolling, hot-rolled sheet annealing, pickling, intermediate annealing, cold rolling, decarburization annealing, applying of an annealing separating agent, and finishing annealing, other than the conditions described above, may be the same as those used in known methods.

Steel containing AlN alone or containing composite AlN and MnSe or MnS as inhibitors applies to the silicon-containing steel according to the present invention. The composition thereof is C: about 0.01 to 0.10 wt %:

Carbon is an element useful not only for uniformizing and fining components in hot rolling and cold rolling but also developing a Goss orientation. The carbon content is essentially at least about 0.01 wt %. However, carbon addition exceeding about 0.10 wt % makes decarbonization difficult and rather disturbs the Goss orientation. Accordingly, the carbon upper limit is about 0.10 wt %. The preferred content of carbon is about 0.03 to 0.08 wt %.

Si: about 2.5 to 4.5 wt %:

Si contributes to specific resistance of a steel sheet and reducing core loss. An Si content of less than about 2.5 wt % does not provide good core loss reduction and causes randomization of crystal direction by α-γ transformation in finishing annealing when carried out at high temperatures for purification and secondary recrystallization. This does not provide the sufficient magnetic characteristics. On the other hand, Si exceeding about 4.5 wt % damages cold rolling properties and makes production difficult. Accordingly, the Si content is limited to about 2.5 to 4.5 wt %. It falls preferably in a range of about 3.0 to 3.5 wt %. Mn: about 0.02 to 0.12 wt %:

Mn is an element useful for preventing cracking caused by hot brittleness in hot rolling. A content of less than about 0.02 wt % does not provide the desired effect. On the other hand, Mn exceeding about 0.12 wt % deteriorates magnetic characteristics. Accordingly, the Mn content is limited to about 0.02 to 0.12 wt %. It falls preferably in a range of about 0.05 to 0.10 wt %. Al: about 0.005 to 0.10 wt %:

Al forms AlN which acts as an inhibitor. An Al content of less than about 0.005 wt % does not provide sufficient inhibiting effect. On the other hand, Al exceeding about 0.10 wt % damages the inhibiting effect. Accordingly, the Al content is controlled to about 0.005 to 0.10 wt %. It falls preferably in a range of about 0.01 to 0.05 wt %.

N: about 0.004 to 0.015 wt %:

N forms AlN which acts as an inhibitor. An N content of less than about 0.004 wt % does not provide sufficient inhibiting effect. On the other hand, an N content exceeding about 0.015 wt % damages the inhibiting effect. Accordingly, the N content is limited to about 0.004 to 0.015 wt %. It falls preferably in a range of about 0.006 to 0.010 wt %.

Se: about 0.005 to 0.06 wt %:

Se forms MnSe which acts as an inhibitor. An Se content of less than about 0.005 wt % does not provide sufficient inhibiting effect. On the other hand, Se exceeding about 0.06 wt % damages the inhibiting effect. Accordingly, the Se content is limited to about 0.005 to 0.06 wt % in either case of single addition or composite addition. It falls preferably in a range of about 0.010 to 0.030 wt %.

S: about 0.005 to 0.06 wt %:

S forms MnS which acts as an inhibitor. An S content of less than about 0.005 wt % does not provide sufficient inhibiting effect. On the other hand, S exceeding about 0.06 wt % damages the inhibiting effect. Accordingly, the S content is limited to about 0.005 to 0.06 wt % in either case of single addition or composite addition. It falls preferably in the range of about 0.015 to 0.035 wt %.

In the present invention, Cu, Sn, Sb, Mo, Te and Bi (other than S, Se and Al described above) act effectively as inhibitor components and therefore can be added as well. The preferred addition ranges of these components are Cu and Sn: about 0.01 to 0.15 wt %, and Sb, Mo, Te and Bi: about 0.005 to 0.1 wt %, respectively. These inhibitor components can be used either alone or in combination.

EXAMPLES

Silicon steel continuous slabs with a thickness of 200 mm and a width of 1000 mm having chemical compositions shown in Table 5, with the balance comprising substantially Fe, were heated up to 1430° C. in a conventional gas heating furnace and induction type heating furnace to subject the inhibitor component to solution. The slabs were subjected to hot rolling at hot finishing rolling terminating temperatures shown in Table 5 and further to controlled cooling in temperature hysteresis as shown in Table 5, followed by coiling the hot-rolled sheets at 550° C. After subjecting the hot-rolled sheets to hot-rolled sheet annealing and pickling, they were subjected to cold rolling and intermediate annealing to intermediate sheet thicknesses and then to cold rolling to final sheet thickness (0.23 mm). Subsequently, the cold-rolled sheets thus obtained were subjected to decarburization annealing at 850° C. for 2 minutes in a wet hydrogen atmosphere. An annealing separating agent containing MgO as a main component was applied. Then, the sheets were subjected to final finishing annealing at 1200° C. for 10 hours in a hydrogen atmosphere. The resulting products were measured for magnetic characteristics and secondary recrystallization rate. The results are shown together in Table 5.

The results shown in Table 5 show that, according to the method of the present invention, all products had excellent magnetic characteristics including high magnetic flux densities and low core losses. Secondary recrystallization was stabilized as well. In contrast with this, in the comparative examples deviating from the scope of the present invention, either the magnetic characteristics or the secondary recrystallization stabilities were inferior.

As described above, the method of the present invention solves the problems involved in conventional methods in the production of grain oriented electromagnetic steel sheet using AlN alone as an inhibitor. It does the same with grain oriented electromagnetic steel sheet using compositely AlN and MnSe or MnS. It makes it possible to manufacture grain oriented electromagnetic steel sheet having excellent magnetic characteristics.

Further, the method of the present invention expedites the development of a secondary recrystallized structure contributing effectively to the enhancement of the magnetic characteristics in the production of grain oriented electromagnetic steel sheet using AlN alone as an inhibitor, and also in grain oriented electromagnetic steel sheet using compositely AlN and MnSe or MnS. In turn makes it possible to manufacture grain oriented electromagnetic steel sheet providing excellent magnetic characteristics including high magnetic flux density and low core loss.

TABLE 5-1

| No. | C (wt %) | Si (wt %) | Mn (wt %) | A (wt %) | N (wt %) | Se (wt %) | S (wt %) | FDT (°C.) | Remarks |
|---|---|---|---|---|---|---|---|---|---|
| 1 | 0.055 | 3.00 | 0.075 | 0.025 | 0.0090 | — | — | 1050 | Comparative example |
| 2 | 0.055 | 3.00 | 0.075 | 0.025 | 0.0090 | — | — | 1050 | Example of this invention |

TABLE 5-1-continued

| No. | C (wt %) | Si (wt %) | Mn (wt %) | A (wt %) | N (wt %) | Se (wt %) | S (wt %) | FDT (°C.) | Remarks |
|---|---|---|---|---|---|---|---|---|---|
| 3 | 0.055 | 3.00 | 0.075 | 0.025 | 0.0090 | — | — | 1050 | Example of this invention |
| 4 | 0.070 | 3.20 | 0.070 | 0.020 | 0.0080 | 0.015 | — | 1000 | Comparative example |
| 5 | 0.070 | 3.20 | 0.070 | 0.020 | 0.0080 | 0.015 | — | 1000 | Example of this invention |
| 6 | 0.070 | 3.20 | 0.070 | 0.020 | 0.0080 | 0.015 | — | 1000 | Example of this invention |
| 7 | 0.060 | 3.05 | 0.060 | 0.022 | 0.0085 | — | 0.011 | 950 | Comparative example |
| 8 | 0.060 | 3.05 | 0.060 | 0.022 | 0.0085 | — | 0.011 | 950 | Example of this invention |
| 9 | 0.060 | 3.05 | 0.060 | 0.022 | 0.0085 | — | 0.011 | 950 | Example of this invention |
| 10 | 0.050 | 2.95 | 0.065 | 0.020 | 0.0095 | 0.014 | 0.009 | 900 | Comparative example |
| 11 | 0.050 | 2.95 | 0.065 | 0.020 | 0.0095 | 0.014 | 0.009 | 900 | Example of this invention |
| 12 | 0.050 | 2.95 | 0.065 | 0.020 | 0.0095 | 0.014 | 0.009 | 900 | Example of this invention |

15

TABLE 5-2

| | Temperature after X sec. since terminating hot rolling | | | | | Cooling rate after 6s | Magnetic characteristics | | Secondary recrystallization percent defective | |
|---|---|---|---|---|---|---|---|---|---|---|
| No. | X = 2 | X = 3 | X = 4 | X = 5 | X = 6 | (°C./s) | $B_8$(T) | $W_{17/50}$(W/kg) | (%) | Remarks |
| 1 | 990 | 900 | 760 | 700 | 660 | 35 | 1.79 | 0.94 | 24 | Comparative example |
| 2 | 880 | 800 | 750 | 700 | 660 | 35 | 1.91 | 0.86 | <1 | Example of this invention |
| 3 | 880 | 800 | 750 | 700 | 660 | 15 | 1.90 | 0.85 | <1 | Example of this invention |
| 4 | 860 | 850 | 840 | 770 | 670 | 30 | 1.80 | 0.92 | 19 | Comparative example |
| 5 | 810 | 790 | 780 | 720 | 640 | 30 | 1.94 | 0.85 | <1 | Example of this invention |
| 6 | 810 | 790 | 780 | 720 | 640 | 20 | 1.97 | 0.81 | <1 | Example of this invention |
| 7 | 840 | 810 | 790 | 770 | 760 | 34 | 1.81 | 0.92 | 22 | Comparative example |
| 8 | 780 | 750 | 720 | 700 | 680 | 34 | 1.94 | 0.85 | <1 | Example of this invention |
| 9 | 780 | 750 | 720 | 700 | 680 | 23 | 1.98 | 0.81 | <1 | Example of this invention |
| 10 | 870 | 840 | 800 | 670 | 640 | 32 | 1.83 | 0.91 | 18 | Comparative example |
| 11 | 800 | 710 | 680 | 660 | 640 | 32 | 1.95 | 0.84 | <1 | Example of this invention |
| 12 | 800 | 710 | 680 | 660 | 640 | 12 | 1.98 | 0.80 | <1 | Example of this invention |

What is claimed is:

1. A method for producing a grain oriented silicon steel sheet having excellent magnetic characteristics, comprising heating a silicon steel slab containing about:

C : 0.01 to 0.10 wt %, Si: 2.5 to 4.5 wt %,

Mn: 0.02 to 0.12 wt %, Al: 0.005 to 0.10 wt %,

N : 0.004 to 0.015 wt %, to about 1280° C. or higher and then subjecting it to hot rolling and cold rolling, and subjecting the cold-rolled steel sheet to decarburization annealing and finishing annealing, wherein the finishing rolling terminating temperature in the hot-rolling step is controlled to a range of about 900° to 1100° C., and wherein the rolled sheet is processed so that the steel sheet 1) temperature T(t) (° C.) after about 2–6 seconds following the termination of hot finishing rolling approximately satisfies the equation:

$$T(t) \leqq FDT-(FDT-700)/6\times t,$$

wherein FDT represents the hot finishing termination temperature (° C.), and t represents an elapsed time of about 2–6 seconds and 2) is cooled down to about 700° C. in about six seconds after termination of said hot finish rolling.

2. A method as defined in claim 1, wherein the silicon steel slab further contains at least one element selected from the group consisting of Se: about 0.005 to 0.06 wt % and S: about 0.005 to 0.06 wt %.

3. A method as defined in claim 2, wherein the steel sheet is cooled at a rate of about 25° C./second or less in the period of from about 6 seconds after termination of the hot finishing rolling step up to coiling.

4. A method for producing a grain oriented silicon steel sheet having excellent magnetic characteristics, comprising heating a silicon steel slab containing about:

C : 0.01 to 0.10 wt %, Si: 2.5 to 4.5 wt %,

Mn: 0.02 to 0.12 wt %, Al: 0.005 to 0.10 wt %,

N : 0.004 to 0.015 wt %, at least one element selected from the group consisting of Se: about 0.005 to 0.06 wt % and S: about 0.005 to 0.06 wt %, to about 1280° C. or higher and then subjecting it to hot rolling and cold rolling, and subjecting the cold-rolled steel sheet to decarburization annealing and finishing annealing, wherein the finishing rolling terminating temperature in the hot-rolling step is controlled to a range of about 900° to 1100° C., and wherein the rolled sheet is processed so that the steel sheet 1) temperature T(t) (° C.) after about 2–6 seconds following the termination of hot finishing rolling approximately satisfies the equation:

$$T(t) \leqq FDT-(FDT-700)/6\times t,$$

wherein FDT represents the hot finishing termination temperature (° C.), and t represents an elapsed time of about 2–6 seconds.

* * * * *

UNITED STATES PATENT AND TRADEMARK OFFICE

CERTIFICATE OF CORRECTION

PATENT NO. : 5,667,598

DATED : September 16, 1997

INVENTOR(S) : Yoshihiro Ozaki, Akio Fujita and Minco Muraki

It is certified that error appears in the above-indentified patent and that said Letters Patent is hereby corrected as shown below:

In Column 11, in Table 3, row 2, line 6, column 4, please change "1.14" to --1.84--.

Signed and Sealed this

Twenty-fifth Day of November, 1997

*Attest:*

*Attesting Officer*

BRUCE LEHMAN

*Commissioner of Patents and Trademarks*